United States Patent [19]

Boyer

[11] Patent Number: 4,501,045

[45] Date of Patent: Feb. 26, 1985

[54] SELF-LOCKING HINGE

[75] Inventor: Jack C. Boyer, Cedar Falls, Iowa

[73] Assignee: Deere & Company, Moline, Ill.

[21] Appl. No.: 491,693

[22] Filed: May 5, 1983

[51] Int. Cl.[3] ..... E05D 11/10

[52] U.S. Cl. ..... 16/331; 16/345; 16/363; 16/376

[58] Field of Search ..... 16/298, 299, 300, 301, 16/329, 330, 331, 332, 334, 341, 342, 344, 345, 347, 353, 363, 364, 376, DIG. 17

[56] References Cited

U.S. PATENT DOCUMENTS

| | | | |
|---|---|---|---|
| 269,411 | 12/1882 | Hart et al. | 16/300 |
| 773,717 | 11/1904 | Craver et al. | 16/329 |
| 1,133,454 | 3/1915 | Banzett | 16/317 X |
| 1,207,270 | 12/1916 | Braithwaite | 16/329 |
| 2,097,651 | 11/1937 | Stangeland | 16/330 |
| 2,362,923 | 11/1944 | Pardoe | 16/330 |
| 3,744,085 | 7/1973 | Griego | 16/330 X |
| 4,073,038 | 2/1978 | Curry et al. | 16/50 X |

FOREIGN PATENT DOCUMENTS

| | | | |
|---|---|---|---|
| 1918162 | 10/1970 | Fed. Rep. of Germany | 16/332 |
| 1342138 | 9/1963 | France | 16/318 |

*Primary Examiner*—Fred A. Silverberg

[57] ABSTRACT

A self-locking hinge is disclosed for pivotally attaching a door to a frame member. The hinge includes first and second hinge members which are pivotally joined together by a pin. A socket is formed in the first hinge member which is designed to receive a detent mechanism. The detent mechanism has at least one tooth formed on its lower surface which will engage a complimentary notch formed on the upper surface of the second hinge member upon rotation of the first hinge member relative to the second hinge member. The tooth and notch are so configured as to permit rotation of the first hinge member in one direction but will prevent its rotation in an opposite direction once the tooth has engaged the notch. A spring is positioned located within the socket of the first hinge member so as to bias the detent downward towards the second hinge member. The self-locking hinge is unique in that it permits the detent mechanism to be inserted into the socket at various angular positions so that the tooth is offset from the notch various degrees. This feature permits a door to be opened different amounts, depending upon its application, before the tooth engages the notch and forms a stop.

2 Claims, 4 Drawing Figures

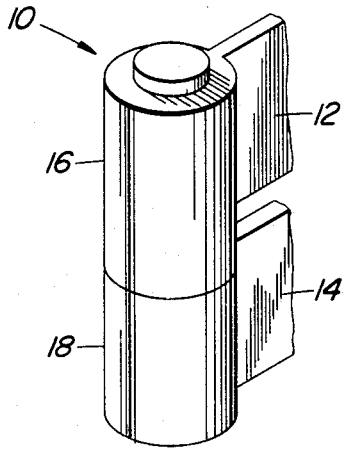
Fig. 1
Fig. 4
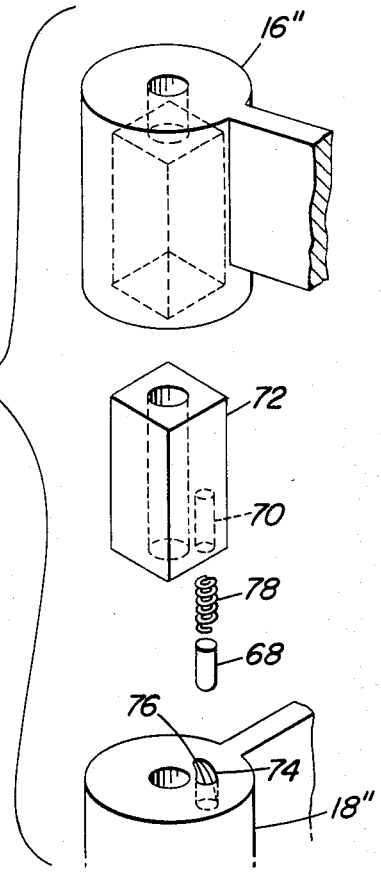

SELF-LOCKING HINGE

FIELD OF THE INVENTION

This invention relates to a self-locking hinge and more particularly to a door hinge having a door stop mechanism which limits the amount the door can be opened.

BACKGROUND OF THE INVENTION

Currently, there are many types of hinges which include locking mechanisms and stop mechanisms so as to limit the amount a door can be opened or to serve as a stop to hold the door in an open position once the mechanism engages. The following U.S. patents provide a sampling of such mechanism: U.S. Pat. Nos. 931,810; 1,054,685; 1,489,679; and 1,603,408. Some of these designs are rather bulky in construction and require a reasonable amount of space in which to function. Others use separate mechanisms, one to hinge the door and a second to provide a detent stop. Most of these devices are rigidly constructed such that it is almost impossible to easily change the amount the hinge may open before the stop is engaged.

Now a self-locking hinge has been invented which is compact in construction and which is adjustable so as to permit the door to open various amounts.

SUMMARY OF THE INVENTION

Briefly, this invention relates to a self-locking hinge which includes a first and a second hinge member. Within the first hinge member is formed a socket which is designed to receive a detent mechanism. The detent mechanism is sized and shaped to be inserted into the socket in different angular positions. On the bottom of the detent mechanism is formed at least one tooth which is designed to engage with a notch formed in the second hinge member. Upon rotation of the first hinge member relative to the second hinge member, the tooth will rotate into alignment with the notch and engage therewith such as to prevent further rotational movement between the two hinge members in one direction while permitting relative rotation in an opposite direction. The detent mechanism is biased towards the second hinge member so as to facilitate engagement of the tooth into the notch.

The general object of this invention is to provide a self-locking hinge which is compact in design and stylish in appearance. A more specific object of this invention is to provide a self-locking hinge for a door which contains a detent mechanism which permits the door to be opened only so far.

Another object of this invention is to provide a self-locking hinge which is constructed of a minimum number of parts and which is easy to manufacture.

Still further, an object of this invention is to provide a self-locking hinge which uses a detent mechanism which can be angularly positioned within a first hinge member so that the door can be opened various degrees.

Still another object of this invention is to provide a simple and economical self-locking hinge which can be used on various size agricultural tractors to hinge a door to the tractor cab.

Other objects and advantages of the present invention will become more apparent to those skilled in the art in view of the following description and the accompanying drawings.

BRIEF DESCRIPTION OF THE DRAWINGS

FIG. 1 is a perspective view of the self-locking hinge in an assembled view.

FIG. 4 is a partial exploded view of another embodiment for the self-locking hinge.

DETAILED DESCRIPTION OF THE PREFERRED EMBODIMENTS

Figure 2:
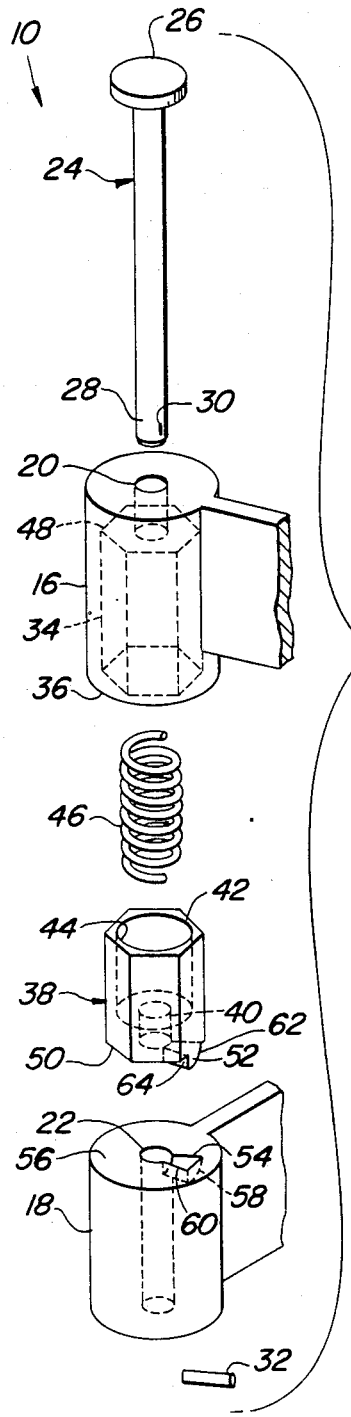
FIG. 2 is an exploded view of the self-locking hinge.

Referring to FIGS. 1 and 2, a self-locking hinge assembly 10 is shown which can be used to pivotally mount a door 12 onto a frame or casting 14. Although the hinge assembly 10 may be used to hinge various members, such as doors, windows, etc., to a stationary member, it is particularly useful for the purpose of hinging a door to a vehicle wherein style and space limitations both have to be satisfied. The hinge assembly 10 includes a first hinge member 16 and a second hinge member 18, both of which are preferably cylindrical in shape. The first and second hinge members 16 and 18, respectively, have longitudinal bores 20 and 22, respectively, formed therethrough. The bores 20 and 22 receive an elongated pin 24. The pin 24 has an enlarged head 26 formed on one end and has an opposite end 28 which projects beyond the bottom surface of the second hinge member 18. Formed in the end 28 is an opening 30 into which is received a pin 32. Although it is necessary to use a device to hold the first and second hinge members 16 and 18 together, means other than the pin 24 can be used.

The first hinge member 16 also has a multi-sided socket 34 formed therein which is axially aligned with the through bore 20 and which is open at an end 36. The socket 34 can be configured with equal or unequal length side members. Although it is possible to configure the socket 34 in a variety of shapes, having either flat or curved sides, or both, for ease of manufacture, it is likely that one will utilize the standard socket shapes, such as a triangle, a square, a rectangle, a polygon, a hexagon, etc. As shown in FIG. 2, the socket is in the form of a hexagon, although other multi-sided configurations, with or without flat side surfaces can be used. An example of a non-flat side could be four outward projecting semi-circles positioned 90 degrees to each other. Insertable into the socket 34 is a detent 38 which is sized and shaped to fit snugly into the socket 34. It should be noted that the detent 38 does not have to have the same number of sides as does the socket 34, although this may be preferable in certain situations. Alternatively, the detent 38 can have a fewer number of sides, an equal number of sides or a greater number of sides than does the socket 34 provided physical indexing between the two members is possible. An example of each are as follows: a triangularly shaped detent mating with a hexagonal socket, a square detent mating with a square socket, and a square detent mating with a octagonal socket.

The detent 38 contains a through bore 40 which can be enlarged at its upper end 42 to form an enlarged bore 44. The enlarged bore 44 serves as a guide for a compression spring 46 which can be inserted therein during assembly. The spring 46 should have an overall length slightly greater than the depth of the enlarged bore 44 so that it will contact a bottom end surface 48 of the socket 34.

Formed on a bottom surface 50 of the detent 38 is a downwardly projecting tooth 52 which is designed to mate with a corresponding notch 54 formed in a top surface 56 of the second hinge member 18. The tooth 52 and notch 54 are configured so as to permit the tooth 52 to engage into the corresponding notch 54 upon rotation of the first hinge member 16 relative to the second hinge member 18. The tooth 52 and the notch 54 also contain a surface which acts as a stop to prevent further rotation of the first hinge member 16 relative to the second hinge member 18. One such configuration is shown in FIG. 2 wherein the notch 54 contains a helical surface 58 which terminates into a side surface 60. The side surface 60 is aligned radially to the central axis of the bore 22 and is arranged perpendicular to the top surface 56. The tooth 52 also contains a helical surface 62 which terminates into a flat face surface 64. Although, only a single tooth and notch arrangement has been described, it is possible to use two or more teeth engaging a corresponding number of notches. When two teeth are used, they are preferably arranged 180 degrees apart and the faces 64 will face in an opposite direction. It should be noted that the notch 54 does not contact the outer periphery of the second hinge member 18 for this would permit the intrusion of dirt or debris into the hinge mechanism which could adversely affect its operation. It is to be understood that other tooth and notch profiles can also be used as well as reversing the location of the tooth and notch such that the tooth is formed on the second hinge member 18 and the notch is formed in the detent 38.

When assembled, the hinge assembly 10 will permit the first hinge member 16 to be rotated relative to the second hinge member 18 until the tooth 52 engages the notch 54. Since the hinge assembly 10 is designed to be used on various types of structures and the door member 12 may have to open various degrees relative to the frame 14, it is necessary that the first member 16 be rotated various degrees before the tooth 52 enters the notch 54 of the second hinge member 18. To accomplish this, the detent 38 can be angularly positioned or indexed within the socket 34 so as to vary the angular distance which the first hinge member 16 can rotate before the tooth 52 engages into the notch 54. For example, in FIG. 2 both the socket 34 and the detent 38 are hexagonal in shape so as to permit insertion of the detent 38 into the socket 34 at different angular positions. This will permit the tooth 52 to be offset from the notch 54 at 60 degree intervals. If the socket 34 had twelve sides and the detent 38 had six sides, then the tooth 54 can be offset from the notch 54 at 30 degree intervals. This novel feature of being able to insert a detent into a corresponding shaped socket, at different angular positions, permits one to design a simple hinge which can provide a stop mechanism at various open positions relative to the closed position of the hinge assembly 10. Such a hinge assembly 10 is particularly useful on a family of agricultural tractors, wherein, as the tractor size increases, the amount that the door can be opened may be restricted due to contact with fenders or with oversized tires. It should also be noted that when a pair of such hinge assemblies 10 are used to provide the pivotal opening and closing of the door 12 relative to the frame 14, that it is only necessary to provide one of the pair of hinge assemblies 10 with the detent mechanism 38.

Figure 3:
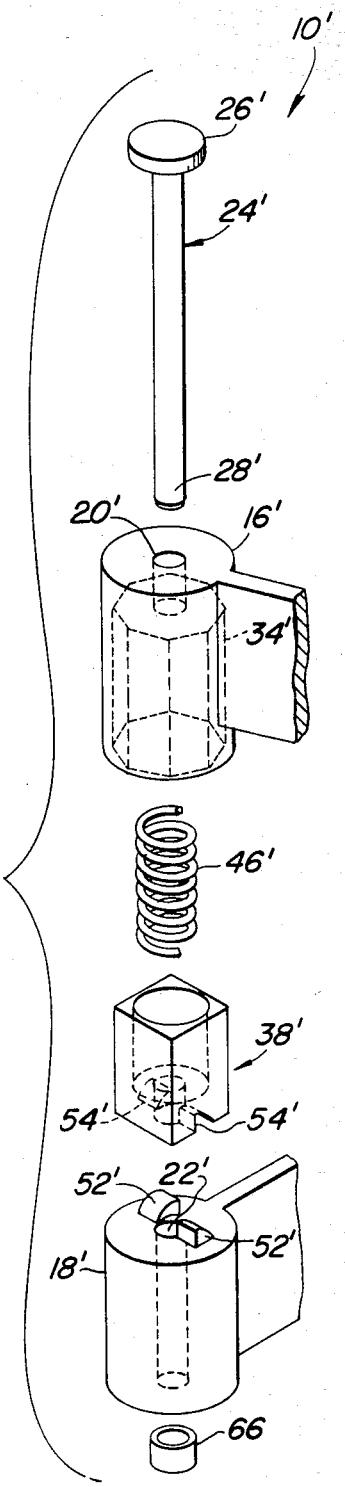
FIG. 3 is an exploded view of an alternative arrangement for the self-locking hinge.

Referring now to FIG. 3, an alternative embodiment 10' is shown having an octagonal socket 34' and a square detent 38'. The detent 38' also contains a pair of notches 54' which are designed to engage with a pair of similarly configured teeth 52' formed on the second hinge member 18'. The pivot pin 24' is also slightly different in that a cap 66 is press-fitted over its second end 28' once the pin 24' has been inserted through the bores 20' and 22', respectively, of the first and second hinge members 16' and 18', respectively.

Turning now to FIG. 4, in situations where the door 12 does not have a lot of weight and where a minimum amount of frictional force is needed to hold the door 12 open relative to the frame 14, it is possible to use a spring loaded pin 68 set into an elongated bore 70 formed in a detent 72. The pin 68 would serve the purpose of the tooth 52 and would engage a groove 74 having a flat end surface 76. In this design, the large diameter spring 46 is replaced by a smaller diameter spring 78.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A self-locking hinge comprising:

(a) a first cylindrical hinge member having a multi-sided socket formed therein and an axial bore formed therethrough;

(b) a second cylindrical hinge member equal in diameter to said first hinge member having an axial bore formed therethrough and having a notch formed in an end thereof which extends radially from said bore, the outer end surface of said notch being spaced apart from the outer periphery of said second hinge member;

(c) a detent having an exterior surface sized and shaped to engage with the interior surface of said socket in a plurality of angular positions of said detent and which contains an axial bore formed therethrough, said detent having a tooth formed on an end thereof which is designed to engage with said notch, said tooth and notch being shaped to permit rotation of said first hinge member relative to said second hinge member in one direction while preventing relative rotation in an opposite direction, the extent of rotation being contingent on the angular displacement of said tooth from said notch as determined by the angular position at which said detent is inserted into said socket, said detent further having an enlarged bore formed in an end thereof which is opposite to said end which contains said tooth;

(d) a spring positioned in said enlarged bore formed in said detent and extending outward therefrom for biasing said detent towards said second hinge member to facilitate engagement of said tooth into said notch upon rotation of said first hinge member relative to said second hinge member;

(e) a pivot pin extending through said axial bore formed in said first and second hinge members and said detent for pivotally joining said members together, said pivot pin having an enlarged first end which contacts an upper surface of said first hinge member and a second end which extends beyond a bottom surface of said second hinge member; and (f) means cooperating with said second end of said pivot pin for axially retaining said detent and said second hinge members in abutting contact.

2. The self-locking hinge of claim 1 wherein both said detent and said socket having a hexagonal configuration wherein said detent can be positioned in said socket such that said tooth is arranged in different angular positions relative to said notch thereby varying the amount said first hinge member can be rotated relative to said second hinge member.

* * * * *